United States Patent [19]

Anderson et al.

[11] Patent Number: 4,582,132

[45] Date of Patent: Apr. 15, 1986

[54] WELLHEAD EXPANSION ASSEMBLY

[75] Inventors: Glenn W. Anderson, Oildale; Odell C. Masters, Bakersfield, both of Calif.

[73] Assignee: Chevron Research Company, San Francisco, Calif.

[21] Appl. No.: 551,627

[22] Filed: Nov. 14, 1983

[51] Int. Cl.[4] ..... E21B 33/047

[52] U.S. Cl. ..... 166/75.1; 166/89

[58] Field of Search ..... 166/56, 75 R, 75 A, 166/88, 89, 302, 303

[56] References Cited

U.S. PATENT DOCUMENTS

| | | | |
|---|---|---|---|
| 1,012,777 | 12/1911 | Wigle | 166/56 |
| 2,117,494 | 5/1938 | Mueller et al. | 166/89 |
| 2,187,839 | 1/1940 | Penick et al. | 166/89 |
| 2,673,615 | 3/1954 | Hanason | 166/84 |
| 2,889,886 | 6/1959 | Gould | 166/75 A |
| 2,934,148 | 4/1960 | Allaire | 166/75 A |
| 3,976,130 | 8/1976 | Chambless et al. | 166/84 |
| 4,390,063 | 6/1983 | Wells, Jr. | 166/84 |
| 4,401,160 | 8/1983 | Anderson et al. | 166/88 |

*Primary Examiner*—Stephen J. Novosad
*Assistant Examiner*—William P. Neuder
*Attorney, Agent, or Firm*—Edward J. Keeling

[57] ABSTRACT

A wellhead expansion assembly for wells having a plurality of tubes carrying hot fluids into and out of a well. Thermal expansion of the tubing is a accommodated by provision of an expansion chamber for termination of each separate string of tubing. Expansion chambers are connected in series, female threaded end to male threaded end. A male end of a first expansion chamber is threadedly engaged with a wellhead donut while a terminal end of a last expansion chamber in the series is threadedly engaged with a cap.

13 Claims, 3 Drawing Figures

WELLHEAD EXPANSION ASSEMBLY

BACKGROUND OF THE INVENTION

The present invention pertains in general to wellhead expansion assemblies and in particular to wellhead expansion assemblies for use with a plurality of tubes extending both through the wellhead and into a well.

Petroleum within some underground formations is so viscous that the temperature and pressure within the formation are insufficient to cause it to flow to a producing well. Hot fluids, particularly steam, are injected into such formations in order to raise the temperature of the formation and thereby reduce the viscosity of the petroleum contained therein to a point at which the petroleum flows to a producing wellbore.

In some wells, it is desirable to treat more than one horizon with hot fluids. Where these horizons require different injection techniques, which may include the use of fluids at different temperatures and different pressures, separate conduction pathways are used for each different type of fluid.

Commonly, metallic steam injection tubing is run into wells which have been drilled and cased. Packers are placed between the tubing and the casing above and sometimes below the formation to be injected. Next, the wellhead is connected to a source of hot fluid, such as a steam generator. The hot fluid is pumped into the formation through the tubing.

The tubing within the well expands when it is exposed to the hot fluid. Axial expansion forces may cause the tubing to be damaged or buckled between fixed subsurface connections and the wellhead if allowance is not made for the expansion.

One approach to compensating for such thermal expansion involves the use of a dome-type packoff wellhead such as the one disclosed in U.S. Pat. No. 4,401,160, assigned to a common assignee. Where either one or more injection tubings are used according to this approach, the dome-type packoff is secured by means of bolts through flanges welded to expansion chambers. Bolts of the sort required are expensive and cannot readily be unscrewed but must be broken off, necessitating replacement of the bolts whenever a chamber is removed. Where more than one injection tubing is used in a well, all tubing strings beyond a first are provided with an expansion joint between a subsurface packer and the wellhead. A first tubing string is allowed to axially expand through a packing gland in the wellhead and into an expansion chamber.

A disadvantage of this approach for use with more than one tubing string is that the tubing must be removed from the well in order to distinguish between a leaking expansion joint and a leaking downhole packer. This is an expensive procedure. Furthermore, a spline joint within an expansion joint may be stripped during removal so that the downhole packer can no longer be conveniently unscrewed. In addition, because O-rings in expansion joints are prone to leakage, it would be desirable to replace expansion joints with packers, which are less prone to leakage.

SUMMARY OF THE INVENTION

Accordingly, it is an object of the present invention to provide a new and improved wellhead expansion assembly.

Among the advantages of the present invention is the replacement of a downhole expansion joint by a packoff assembly located above the surface. In addition, because the packoff assembly is above the wellhead, it may be repacked without having to pull the well. Another advantage of the present invention is that the components of the present invention are significantly less expensive than are the structures it replaces.

These and other objects and advantages of the present invention will become apparent to those skilled in the art upon consideration of the accompanying specification, claims and drawings.

In order to attain the above-mentioned and other objects and advantages and apparatus according to the present invention involves a wellhead expansion assembly for use with a plurality of tubes extending through the wellhead and extending into a well. This apparatus comprises a plurality of expansion chambers associated with means for sealing each of the plurality of expansion chambers above the wellhead.

Another apparatus according to the present invention comprises a plurality of expansion chambers connected in a series beginning at the wellhead. A plurality of tubes pass through the wellhead and through the plurality of expansion chambers with at least one of the plurality of tubes terminating in each expansion chamber. At least one of a plurality of packing glands seals each expansion chamber around at least one of the plurality of tubes.

Yet another wellhead expansion assembly according to the present invention comprises first packing material within a cavity of a donut. An expansion chamber is threadedly engaged with the donut and compresses the packing material within the cavity.

Still another wellhead expansion assembly according to the present invention comprises at least one expansion chamber having a threaded end threadedly engaged with a threaded end of an expansion chamber mating structure. Packing material is compressed between the threaded end of the at least one expansion chamber and the expansion chamber mating structure.

DESCRIPTION OF THE PREFERRED EMBODIMENTS

Figure 1:
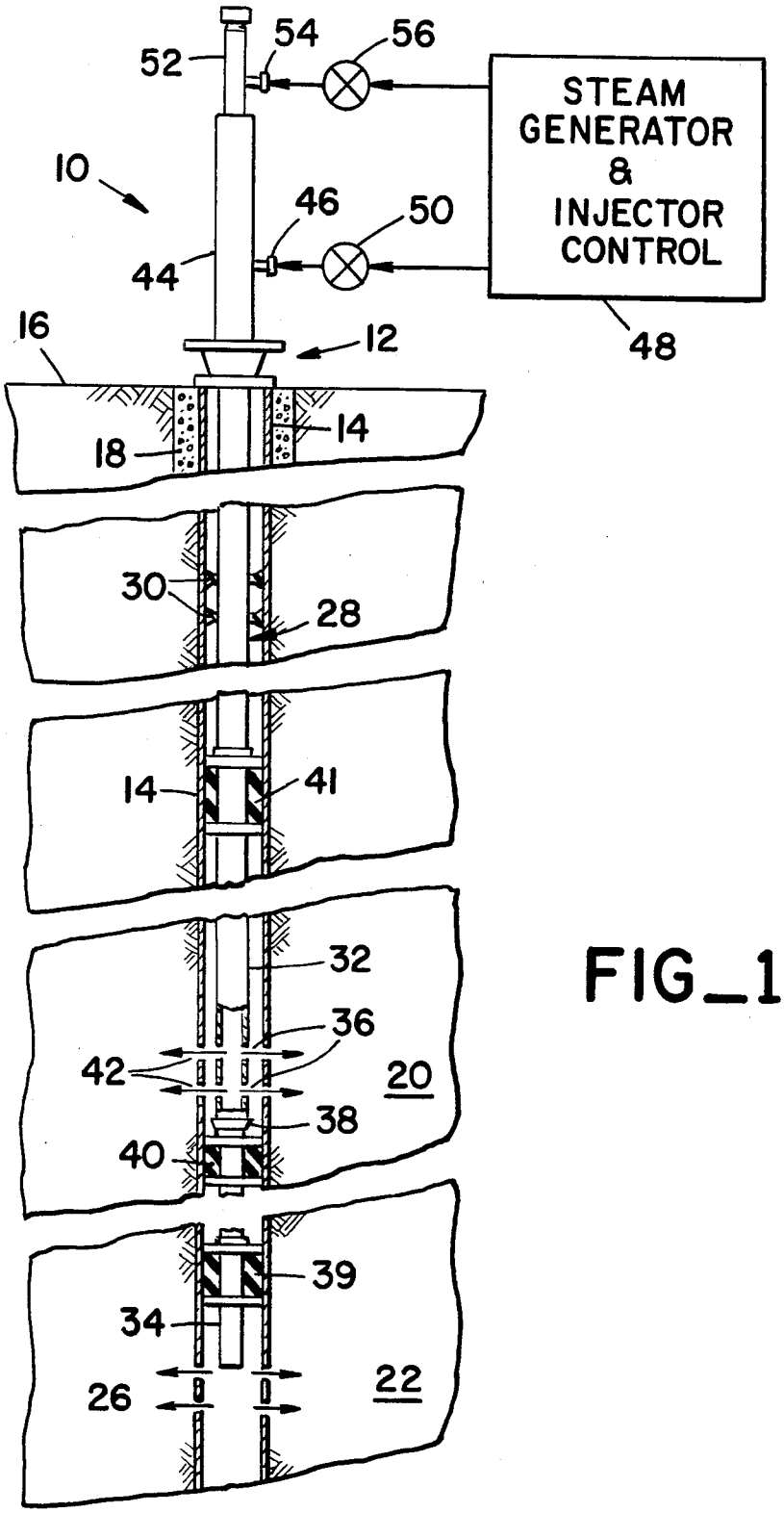
FIG. 1 is a view in partial section of a wellbore connected to a wellhead configuration in accordance with the present invention.

In a preferred embodiment of the present invention, as illustrated in FIG. 1, a wellhead expansion assembly 10 is mounted on a wellhead 12 at the surface termination of a casing 14. Casing 14 is affixed to an earth formation 16 by cement 18. Beneath the surface of formation 16, casing 14 penetrates producing horizons 20 and 22. At horizons 20 and 22, casing 14 is perforated by openings 42 and 26, respectively.

A tubing string 28 is centralized in the casing by non-conductive centralizers 30 within casing 14. Tubing string 28 comprises an outer tubing 32 and an inner tubing 34. Outer tubing 32 is perforated by openings 36 adjacent to openings 24 in horizon 20. Outer tubing 32 is terminated in a stab-in shoe 38 at horizon 20. Inner tubing 34 has an open end adjacent to perforations 26 at horizon 22.

A first expansion chamber 44 has a port 46 connected to a steam generator and injector control apparatus 48 by way of a valve 50. A second expansion chamber 52 is connected to expansion chamber 44 which is in turn connected with wellhead 12 to form a series of expansion chambers beginning at wellhead 12. Second expansion chamber 52 has a port 54 connected to steam generator and injector control apparatus 48 by way of a valve 56. Tubing 32 terminates within expansion chamber 44 while tubing 34 terminates within expansion chamber 52.

A first downhole packer 39 and second downhole packer 40, opposed to packer 39, isolate horizon 20 from horizon 22. A third downhole packer 41, up hole of perforations 36 cooperates with packer 40 to isolate horizon 20.

A first hot fluid is injected through valve 50 and port 46 into expansion chamber 44 wherein it enters tubing 32. The first hot fluid then passes between tubing 32 and tubing 34 along tubing string 28 until it reaches perforations 36. The first hot fluid passes out of tubing 32 through perforations 36 and out of casing 14 through perforations 42 into horizon 20.

A second hot fluid is injected through valve 56 and port 54 into expansion chamber 52. Within expansion chamber 52 the secohd hot fluid enters tubing 34. The second hot fluid passes along tubing 34 out of the open end of tubing 34 and through casing 14 by way of perforations 26 into horizon 22.

Figure 2:
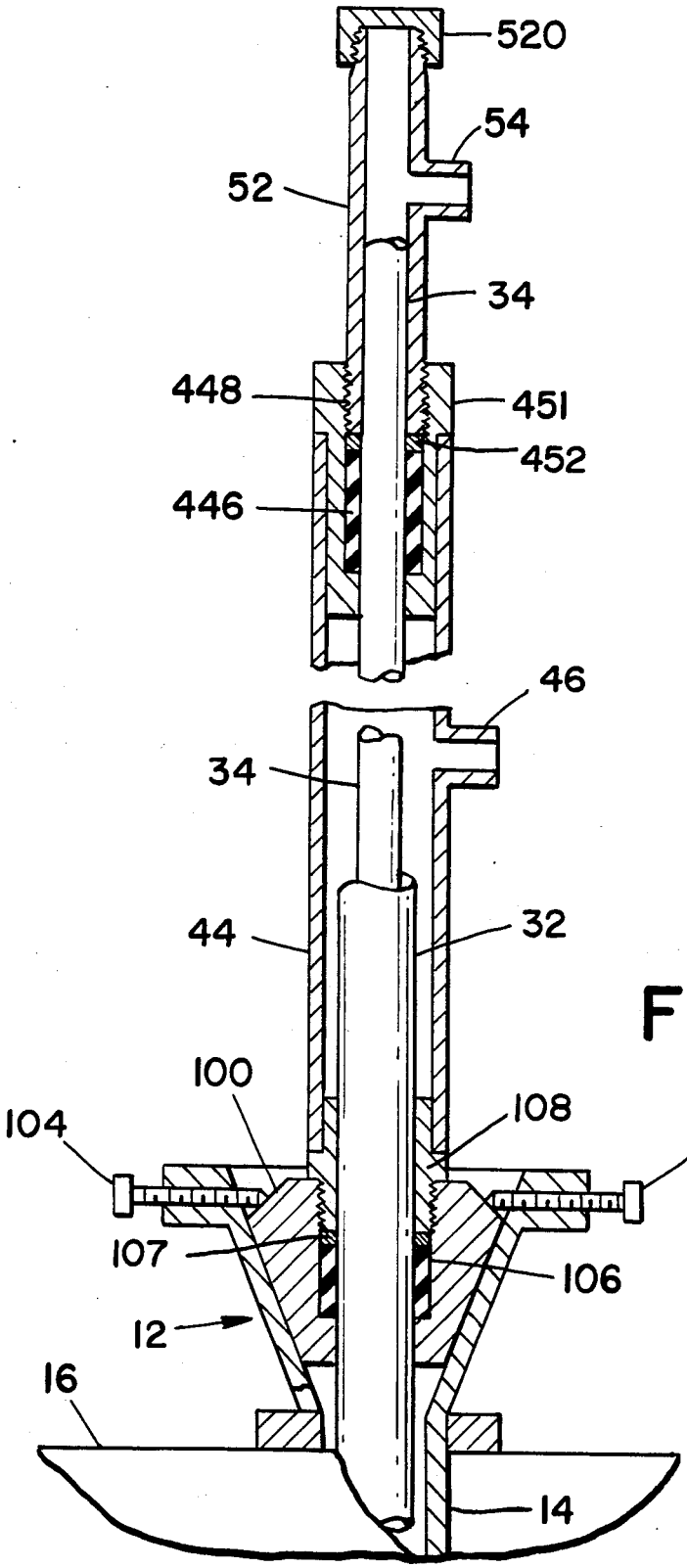
FIG. 2 is a cross-sectional view of a first embodiment of a wellhead expansion assembly according to the present invention.

A first embodiment of a wellhead expansion assembly according to the present invention is illustrated in FIG. 2. In FIG. 2, structures which are also shown in FIG. 1 are identified by the same reference numerals used to identify them in FIG. 1.

A donut 100 is affixed to wellhead 12 by means of bolts 102 and 104 which are tightened to overlap a beveled portion of donut 100. A first packing gland is formed by a first packing material 106 within an unthreaded portion of a cylindrical cavity formed by a central cylindrical surface of donut 100.

A first end of expansion chamber 44 is welded to a male, threaded insert 108 slipped within the first end to form a first expansion chamber mating structure. Insert 108 is screwed into a threaded portion of the cavity within donut 100 in order to compress packing material 106 against a shelf within cavity 100 and around outer tubing 32, which passes through the hollow portion of donut 100 into expansion chamber 44. Proper compression of packing material 106 ensures that expansion chamber 44 is sealed to maintain chamber pressure. Insert 108 may be considered to be part of expansion chamber 44.

A stripping ring 107 is interposed between packing material 106 and insert 108. Stripping ring 107 is used to scrape away salt incrustations around tubing 32 in order to prevent damage to packing material when tubing 32 longitudinally contracts downward through expansion chamber 44.

A second end of expansion chamber 44 is welded to a female threaded insert 451 which is slipped within the second end and welded thereto to form a second expansion chamber mating structure. Insert 451 has a cylindrical inner surface defining a cylindrical cavity within expansion chamber 44. Insert 451 may be considered to be part of expansion chamber 44. A second packing gland is formed by compression of a second packing material 446 against a shelf within the cavity of insert 451 and against tubing 34.

A stripping ring 452 is interposed between packing material 446 and chamber 52. Stripping ring 452 is used to scrape away salt incrustations around tubing 34 in order to prevent damage to packing material 446 when tubing 34 longitudinally contracts downward through expansion chamber 52.

The second expansion chamber 52 has a first, male, threaded end 448 which is screwed into a female threaded portion in female insert 451 within expansion chamber 44. Tubing 34 terminates within expansion chamber 52. A second, V-threaded, male end of expansion chamber 52 is engaged by the threads of a cap 520 covering an upper end of expansion chamber 52 which may serve as a workover port.

The second packing gland comprising packing material 446 serves to isolate the first expansion chamber from the second expansion chamber. The second expansion chamber is isolated from the atmosphere by cap 520.

Tubing string 34 terminates within expansion chamber 52 just as tubing string 32 terminates within expansion chamber 44. Steam passes from port 46 through the hollow interior of cylindrical expansion chamber 44 and into the open end of outer tubing 32. Likewise, steam passes from port 54 through the hollow interior of cylindrical expansion chamber 52 into the open end of inner tubing 34. In this way, there is no requirement for a direct physical connection between ports 46 and 54 and tubing 32 and 34, respectively.

The respective lengths of expansion chambers 44 and 52 are selected based upon a determination of the increase in length of the respective tubing expected in view of the thermal environment provided by the injected steam.

Ports 46 and 54 may be welded half couplings of the sort readily manufactured by those skilled in the art. Donut 100 may be a readily available wellhead donut modified by machining to provide a cavity for the packing gland as herein described. Expansion chambers and inserts may comprise machined pipe. All other elements of the present invention are well known and readily available to one skilled in the art so that further discussion of them is not required.

Figure 3:
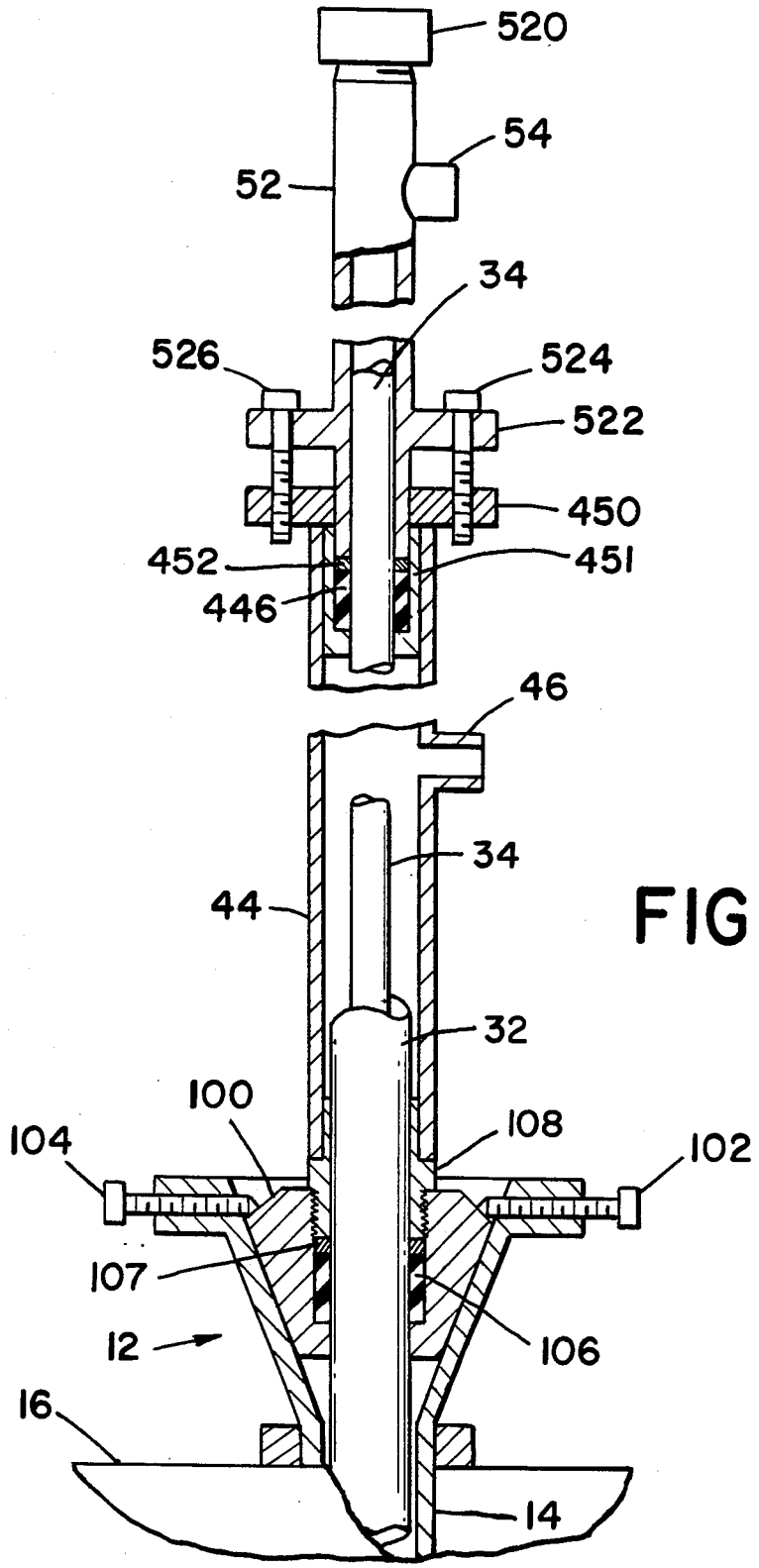
FIG. 3 is a view in partial section of a second embodiment of a wellhead expansion assembly according to the present invention.

An alternative embodiment according to the present invention for use at higher steam pressures is illustrated in FIG. 3. Elements also found in FIGS. 1 and 2 are identified by the same reference numerals used to identify them in FIGS. 1 and 2. FIG. 2 differs from FIG. 3 in that the first end of expansion chamber 52 and the female insert within expansion chamber 44 are not threaded, but are welded to flanges 450 and 522, respectively. Flanges 450 and 522 are secured together by bolts 524 and 526.

The present invention eliminates need for a downhole expansion joint. Furthermore, the present invention allows the packoff on each of the tubing strings to be readily identified as a source of a particular leak. Location of packing material 106 and 446 above the surface of the wellhead allows easy repacking without having to pull the well in order to do so.

While the present invention has been described in terms of a preferred embodiment, further modifications and improvements will occur to those skilled in the art. For example, the present invention is not limited to two tubing strings, but may be used with a plurality of tubing strings connected in series from a wellhead to a terminal cap. In addition, where it is practical to do so, the structures described above as appearing on inserts may be machined from the corresponding expansion chamber.

We desire it to be understood, therefore, that this invention is not limited to the particular form shown and that we intend in the appended claims to cover all such equivalent variations which come within the scope of the invention as claimed.

What is claimed is:

1. A wellhead expansion assembly, for use with a plurality of tubes extending through the wellhead and extending into a well, comprising:

tubular means defining plurality of expansion chambers;

a plurality of tubes passing through the wellhead and through said plurality of expansion chambers at least one of said plurality of tubes terminating in each of said plurality of expansion chambers;

means, associated with said plurality of expansion chambers, for sealing each of said plurality of expansion chambers above the well;

means associated with said means for sealing, for permitting longitudinal expansion and contraction of the tubes through said means for sealing; and means for connecting a steam generator to said plurality of expansion chambers.

2. The wellhead expansion assembly as recited in claim 1 wherein said means for sealing comprises a threaded portion on at least one of said expansion chambers.

3. The wellhead expansion assembly as recited in claim 2 further comprising a donut having a threaded portion engaging said threaded portion of said at least one expansion chamber.

4. The wellhead expansion assembly as recited in claim 2 wherein at least one of said expansion chambers has a flange and further comprising an expansion chamber mating structure having a flange fastened to said flange of said at least one expansion chamber.

5. The wellhead expansion assembly of claim 4 wherein said expansion chamber mating structure is connected to a second expansion chamber from among said plurality of expansion chambers.

6. A wellhead expansion assembly comprising:

a tubular means defining a plurality of expansion chambers connected in a series beginning at the wellhead;

a plurality of tubes passing through the wellhead and through said plurality of expansion chambers, at least one of said plurality of tubes terminating in each expansion chamber;

a plurality of packing glands, at least one of said plurality of packing glands sealing each expansion chamber around at least one of said plurality of tubes; and means, associated with each of said packing glands, for permitting longitudinal expansion and contraction of said plurality of tubes through said packing glands.

7. The wellhead expansion assembly as recited in claim 6 wherein at least one of said expansion chambers has at least one end threadedly engaged with an end of a second from among said plurality of expansion chambers.

8. The wellhead expansion assembly as recited in claim 6 further comprising a donut and wherein at least one of said expansion chambers has at least one end threadedly engaged with said donut.

9. The wellhead expansion assembly as recited in claim 8 wherein at least one of said plurality of expansion chambers comprises a flange and further comprising an expansion chamber mating structure having a flange fastened to said flange of said at least one expansion chamber.

10. The wellhead expansion assembly as recited in claim 9 where said expansion chamber mating structure is connected to a second from among said plurality of expansion chambers.

11. A wellhead expansion assembly, for use with at least one tube extending through a wellhead and into a well, comprising:

at least one expansion chamber having at least one threaded end;

an expansion chamber mating structure having a threaded inner surface threadedly engaged with said at least one threaded end, said threaded inner surface defining a cavity containing a shelf; and packing material compressed by said threaded end of said at least one expansion chamber against said shelf within said cavity of said expansion chamber mating structure.

12. The wellhead expansion assembly as recited in claim 11 wherein said expansion chamber mating structure comprises a second expansion chamber.

13. The wellhead expansion assembly as recited in claim 12 wherein said expansion chamber mating structure comprises a donut.

* * * * *